United States Patent [19]

Kostecky

[11] 4,154,038

[45] May 15, 1979

[54] PEDESTAL HEAD FOR FLOOR-SUPPORTING POST

[75] Inventor: James F. Kostecky, Bethlehem, Pa.

[73] Assignee: Bethlehem Steel Corporation, Bethlehem, Pa.

[21] Appl. No.: 803,691

[22] Filed: Jun. 6, 1977

[51] Int. Cl.[2] ..... E04H 12/00; E04B 5/43

[52] U.S. Cl. ..... 52/301; 52/263; 52/713; 248/357

[58] Field of Search ..... 52/126, 73, 301, 263, 52/702, 712, 703, 713, 714, 715; 248/300, 357, 248; 403/173, 176, 177

[56] References Cited

U.S. PATENT DOCUMENTS

| | | | |
|---|---|---|---|
| 2,086,009 | 7/1937 | Walker | 52/301 X |
| 3,067,843 | 12/1962 | Rushtoh et al. | 52/126 |
| 3,157,254 | 11/1964 | Spiselman et al. | 52/126 X |
| 3,425,179 | 2/1969 | Haroldson | 52/126 X |
| 3,589,660 | 6/1971 | Dunckel | 52/714 X |
| 3,616,584 | 11/1971 | Sartori et al. | 52/126 |
| 3,785,110 | 1/1974 | Galloway et al. | 52/715 |
| 3,900,995 | 8/1975 | Ehrenberg | 52/126 |

FOREIGN PATENT DOCUMENTS

| | | | |
|---|---|---|---|
| 704080 | 2/1965 | Canada | 248/357 |
| 1450491 | 7/1966 | France | 52/126 |
| 45871 | 12/1928 | Norway | 52/712 |
| 440423 | 12/1935 | United Kingdom | 403/173 |
| 1054411 | 1/1967 | United Kingdom | 52/263 |

*Primary Examiner*—Leslie Braun

*Attorney, Agent, or Firm*—Joseph J. O'Keefe; Michael J. Delaney; Anson W. Biggs

[57] ABSTRACT

Rectangular floor panels are supported at each corner by a pedestal head. The pedestal head is supported by a vertical post and is formed of a single piece of sheet metal. The head has four orthogonally disposed arms extending outwardly, and each arm is provided with depending surfaces that engage a face of the post.

2 Claims, 5 Drawing Figures

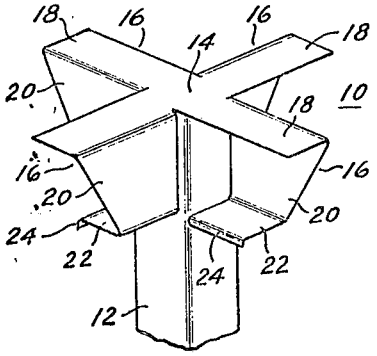
FIG. 2
FIG. 1
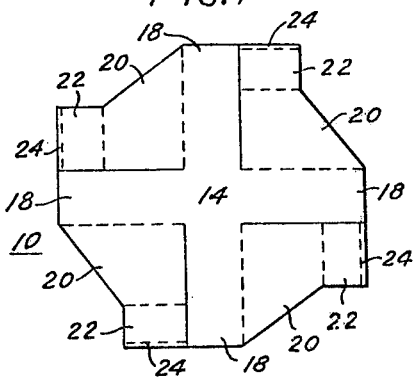
FIG. 4
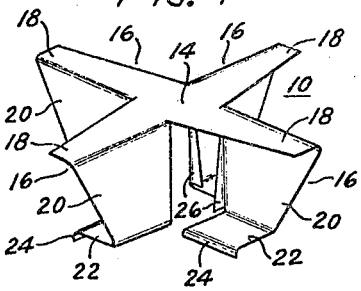
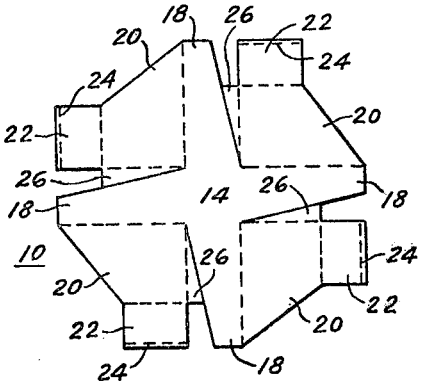
FIG. 3
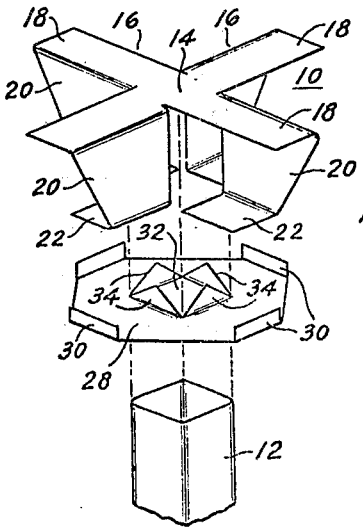
FIG. 5

PEDESTAL HEAD FOR FLOOR-SUPPORTING POST

BACKGROUND OF THE INVENTION

This invention relates to elevated floors. More particularly, it relates to a pedestal head for an elevated floor-supporting post.

Certain types of electronic equipment, e.g., large digital computers, are generally installed on an elevated floor so that cables, pipes, etc., may be installed beneath this equipment and may be easily serviced in the event of malfunctioning thereof. The floor is comprised of a plurality of quadrilateral floor panels, each panel being readily removable so that the cables and pipes directly thereunder are immediately accessible. Each corner of every panel is supported by a pedestal head that is resting on a post.

In the past, some types of pedestal heads were cast of aluminum. In an effort to reduce costs, more recent types of heads were constructed of four separate arm sections that were each stamped from sheet steel and welded to the pedestal post.

It is an object of this invention to provide a pedestal head made of a single piece of sheet metal.

SUMMARY OF THE INVENTION

I have discovered that the foregoing object can be obtained by providing a single piece of sheet metal comprising a central portion adapted to rest upon the top of a post. A plurality of channel-shaped arms extends outwardly from this central portion. Each arm comprises a horizontal top flange coplanar with said central portion, a web extending downwardly from each of said top flanges, and a bottom flange extending horizontally from each of said webs.

BRIEF DESCRIPTION OF THE DRAWINGS

FIG. 1 is a plan view of a blank of the preferred pedestal head of the invention, the blank being punched out from a piece of sheet steel, but not yet formed into its final shape.

FIG. 2 is an isometric view of a pedestal head formed from the blank of FIG. 1 and mounted on a post.

FIG. 3 is a plan view of a blank of an alternative pedestal head of the invention, this blank being punched out from a piece of sheet steel, but not yet formed into its final shape.

FIG. 4 is an isometric view of a pedestal head formed from the blank of FIG. 3.

FIG. 5 is an exploded isometric view of another embodiment of the subject invention.

DESCRIPTION OF THE PREFERRED EMBODIMENT

FIG. 1 shows a blank of the preferred pedestal head 10 of the invention. The blank is formed from a single piece of sheet steel. FIG. 2 shows the blank of FIG. 1 formed into the pedestal head 10 and mounted on a post 12, the cross section of the post 12 being square. The pedestal head 10 comprises a central portion 14 adapted to rest upon the top of the post 12. A plurality of channel-shaped arms 16 extends outwardly from the central portion 14.

Each of the arms 16 comprises a horizontal top flange 18 coplanar with the central portion 14, a web 20 extending downwardly from each of the top flanges 18, and a bottom flange 22. If additional stiffness is required, each bottom flange 22 is provided with a vertically depending stiffening lip 24. Preferably, this lip extends downwardly, since this results in a greater degree of stiffness than does an upward extension. The pedestal head 10 has sufficient strength so that it can be mounted on the post 12 without any additional fabricating operations, e.g., spot welding of the head 10 to the post 12.

FIG. 3 shows a single piece of sheet steel punched into a blank for an alternative form of the invention, but not yet formed into its final shape as shown in FIG. 4. The solid lines show the cuts in the steel, whereas the dashed lines show the bends. As shown, the horizontal flanges 18 in this case are tapered outwardly. This is necessary because a tab 26 is attached to each web 20 to provide means for spot welding the pedestal head 10 to the post 12. Spot welding permits the use of a lighter gauge steel than that used in the preferred pedestal head embodiment of FIGS. 1 and 2.

FIG. 5 shows an embodiment of the invention that permits an even lighter gauge steel sheet to be used for the pedestal head. The head itself is formed without any stiffening lips, and a bottom plate 28 is provided. The plate 28 is preferably provided with a plurality of tabs 30 that are adapted to be folded over the bottom flanges 22. If desired, these tabs 30 may be omitted, and the bottom plate 28 may be rigidly affixed to the bottom flanges 22 by other means, e.g., by spot welding.

The bottom plate 28 is provided with a centrally disposed opening 32 the periphery of which is adapted to engage the periphery of the post 12. This opening 32 is formed by slitting the plate 28 diagonally and bending the material adjacent to the diagonals upwardly into four triangular tabs 34. The pedestal head-bottom plate combination can be provided with additional strength by folding the tabs 34 downwardly over the bottom flanges 22.

I claim:

1. A pedestal head for a vertical post adapted to support floor panels, said pedestal head being formed of a single piece of sheet metal and comprising:

(a) a central portion adapted to rest upon the top of said post, (b) a plurality of channel-shaped arms depending from said central portion, each of said arms adapted to engage a face of said post and comprising:

(i) a horizontal top flange coplanar with said central portion, (ii) a web extending downwardly from each of said top flanges, and (iii) a bottom flange extending horizontally from each of said webs, and (c) a flat plate having a centrally disposed opening therein, the periphery of said opening engaging the periphery of said post, and having a plurality of upwardly extending tabs on said periphery of said opening, each of said tabs being folded over one of said bottom flanges.

2. A pedestal head for a vertical post adapted to support floor panels, said pedestal head being formed of a single piece of sheet metal and comprising:

(a) a central portion adapted to rest upon the top of said post, (b) a plurality of channel-shaped arms depending from said central portion, each of said arms adapted to engage a face of said post and comprising:

(i) a horizontal top flange coplanar with said central portion, (ii) a web extending downwardly from each of said top flanges, and (iii) a bottom flange extending horizontally from each of said webs, and (c) a flat plate secured to each said bottom flange extending horizontally from each of said webs, said plate being provided with an opening the periphery of which is adapted to engage the periphery of said post.

* * * * *